US008302783B1

(12) United States Patent
Harris et al.

(10) Patent No.: US 8,302,783 B1
(45) Date of Patent: Nov. 6, 2012

(54) PRODUCT DISPENSING DISPLAY

(76) Inventors: Scott Harris, Bella Vista, AR (US); Charles Jennings, Bentonville, AR (US)

( * ) Notice: Subject to any disclaimer, the term of this patent is extended or adjusted under 35 U.S.C. 154(b) by 254 days.

(21) Appl. No.: 12/806,169

(22) Filed: Aug. 6, 2010

Related U.S. Application Data

(60) Provisional application No. 61/273,605, filed on Aug. 6, 2009.

(51) Int. Cl.
*A47F 7/00* (2006.01)

(52) U.S. Cl. ..... 211/59.3

(58) Field of Classification Search ..... 211/59.2, 211/59.3, 51, 184, 49.1, 50, 13.1; 312/35, 312/42, 61, 71; 221/226, 247, 155, 124, 221/185, 252, 257, 276, 227, 255, 279, 25, 221/280, 268, 270, 271
See application file for complete search history.

(56) References Cited

U.S. PATENT DOCUMENTS

| | | | | |
|---|---|---|---|---|
| 1,323,442 | A | 12/1919 | Bemis | |
| 2,083,843 | A * | 6/1937 | Hicks | 312/71 |
| 2,494,030 | A * | 1/1950 | Blondin | 211/11 |
| 3,212,667 | A * | 10/1965 | Kleist et al. | 312/50 |
| 3,395,958 | A * | 8/1968 | Hospes | 312/61 |
| 3,410,455 | A | 11/1968 | Haas | |
| 3,625,397 | A | 12/1971 | Shelly et al. | 221/155 |
| 4,305,628 | A * | 12/1981 | Glasener | 312/42 |
| 4,515,290 | A | 5/1985 | Fishler | 221/124 |
| 5,178,298 | A * | 1/1993 | Allina | 221/24 |
| 5,460,295 | A | 10/1995 | Law | 221/185 |
| 5,665,304 | A | 9/1997 | Heinen et al. | 312/71 |
| 6,206,235 | B1 * | 3/2001 | Green | 221/251 |
| 6,230,931 | B1 | 5/2001 | Mandle et al. | 221/247 |
| 6,536,609 | B2 | 3/2003 | Lake | 211/593 |
| 6,550,636 | B2 * | 4/2003 | Simpson | 221/59 |
| 6,749,071 | B2 | 6/2004 | Caterinacci | 211/40 |
| 6,955,268 | B2 | 10/2005 | Waldron | 211/51 |
| 7,637,048 | B2 * | 12/2009 | Tal et al. | 42/87 |
| 7,896,172 | B1 * | 3/2011 | Hester | 211/59.3 |
| 2001/0000643 | A1 * | 5/2001 | Roeker et al. | 312/61 |
| 2004/0168995 | A1 * | 9/2004 | Ignoffo et al. | 211/51 |
| 2005/0161413 | A1 * | 7/2005 | Close | 211/51 |
| 2007/0045336 | A1 | 3/2007 | Munoz et al. | 221/226 |
| 2008/0135507 | A1 | 6/2008 | Hardy et al. | 211/59.3 |

* cited by examiner

*Primary Examiner* — Jennifer E. Novosad
(74) *Attorney, Agent, or Firm* — Keisling & Pieper, PLC; Meredith K. Lowry

(57) ABSTRACT

A dispensing display assembly is provided which can deter the theft of goods without prohibitively restricting the access to goods. The display is made from corrugated paper or a thin walled plastic.

17 Claims, 9 Drawing Sheets

PRODUCT DISPENSING DISPLAY

CROSS-REFERENCE TO RELATED APPLICATIONS

This application claims priority to and is a continuation of U.S. Application Ser. No. 61/273,605, filed Aug. 6, 2009, which is hereby incorporated by reference in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to the field of display systems in general. In particular, the present invention relates specifically to a display system having multiple dispensing arms providing product to consumers.

2. Description of the Known Art

As will be appreciated by those skilled in the art, plastic and corrugated cardboard displays provide a means for inexpensively advertising and/or displaying products in a retail or display environment. The majority of displays are static fixtures that provide shelving elements to house products. Attempts have been made to maximize the shelf space of displays by providing tracks with flat panel that propel stock items to the front of a display. Details of a typical product dispensing displays are contained in U.S. Pat. No. 1,323,442 issued to Bemis on Dec. 2, 1919; U.S. Pat. No. 3,410,455 issued to Haas on Nov. 12, 1968; U.S. Pat. No. 3,625,397 issued to Shelly et al. on Dec. 7, 1971; U.S. Pat. No. 4,515,290 issued to Fishier on May 7, 1985;U.S. Pat. No. 5,460,295 issued to Law on Oct. 24, 1995; U.S. Pat. No. 5,665,304 issued to Heinen et al. on Sep. 9, 1997; U.S. Pat. No. 6,230,931 issued to Mandle et al. on May 15, 2001; U.S. Pat. No. 6,536,609 issued to Lake on Mar. 25, 2003; U.S. Pat. No. 6,749,071 issued to Caterinacci on Jun. 15, 2004; U.S. Pat. No. 6,955,268 issued to Waldron on Oct. 18, 2005; United States Patent Publication No. 2007/0045336 filed by Munoz et al. and published on Mar. 1, 2007; and United States Patent Publication No. 2008/0135507 filed by Hardy et al. and published on Jun. 12, 2008. Each of these patents is hereby expressly incorporated by reference in their entirety.

In the past, display assemblies have been designed for both display and dispensing purposes. However, these display assemblies have had a variety of issues in regards to liability, namely the theft of goods. For example, display assemblies are typically open, allowing thieves to access mass quantities of goods without restriction. For instance, shelving displays that feature pharmaceuticals or other small items are typically stack displays within an open area. Thieves are able to rapidly access the goods by placing a shopping cart, basket, or open carton below the open area and swipe the back of the display with an extended arm, thus moving all of the product off the display into the open carton. In this manner, a thief can be many feet away from the display before a store attendant is aware of any malfeasance. Dispensing displays that push the goods slowly towards an opening add to this problem. Displays that prevent any access to the goods require constant attendance by a store employee, thus increasing costs for the store and limiting consumer purchasing. Hence, a need exists for dispensing display assembly which can deter the theft of goods without prohibitively restricting the access to goods.

U.S. Pat. No. 1,323,442 issued to Bemis on Dec. 2, 1919 entitled Cigarette Case teaches a metallic housing into which a package of cigarettes may be inserted, and from which the cigarettes may be easily ejected, one at a time.

U.S. Pat. No. 3,410,455 issued to Haas on Nov. 12, 1968 entitled Dispensing Device for Tablets teaches a dispensing device for tablets of longitudinal shape, particularly of prismatic configuration, comprising a housing adapted to receive a plurality of tablets in the form of a pill, the tablets constituting a first member, the housing having a bottom and an intermediate bottom disposed in the housing intermediate its open upper end and the bottom, spring means disposed between the intermediate bottom and the bottom of the housing and urging the intermediate bottom to its uppermost position, and the housing defining a tablet receiving range and in its upper position a dispensing range adapted to dispense the uppermost of the pile of tablets disposed substantially in the tablet receiving range. A cover member is provided swingably mounted on top of the housing and the cover includes the sliding-out member entering the dispensing rage upon swinging the cover member from its housing-closing position to its open position. The dispensing range of the housing is defined by at least three walls, constituting second members and dispensing laterally the uppermost of the tablets in the direction perpendicular to the direction of movement of the tablets in the pile and at least one of the members has at least one projection extending into the dispensing range for the projection and is adapted to be received by a complementary recess of the other of the members, so that having no recesses cannot be dispensed by the device.

U.S. Pat. No. 3,625,397 issued to Shelly et al. on Dec. 7, 1971 entitled Container Display and Dispenser teaches a beverage dispenser having a cartridge including a tube for holding a stack of containers, a stop spaced from one end of the tube by about the height of a container, and a spring in the tube for urging the stack of containers toward the stop and to urge the end container against the stop. The end container may be viewed for display purposes and also may be removed from the tube with the spring pushing another container against the stop. The cartridge is carried in a cart, and in this application, a plurality of the tubes are arranged side-by-side with the stop projecting above the upper surface of the cart so that a plurality of containers are viewable at the top of the cart and can be dispensed easily from the top of the cart. A spring normally holds the containers under the stop, and the spring is yieldable to allow removal of the containers from the cartridge. A loader is provided consisting of a tube which may be inserted under the stop to release the spring, the tube carrying containers for either loading the containers into the cartridge or removing containers from the cartridge.

U.S. Pat. No. 4,515,290 issued to Fishier on May 7, 1985 entitled Article Dispensing Apparatus teaches a dispenser for articles comprised of a plurality of laterally interlocking planar partitions with a space between adjacent partitions to form a column for storing the articles to be dispensed. One end of the column defines a customer receiving position for dispensing a last-to-be loaded article from the column. Each column has means that urges the articles towards the customer receiving or dispensing position to hold the last-to-be loaded and first-to-be dispensed article thereat. A slight movement of the article held in the dispensing position causes the same to eject partially therefrom.

U.S. Pat. No. 5,460,295 issued to Law on Oct. 24, 1995 entitled Candy Dispensing System teaches a candy dispensing system is provided comprising a housing in which is defined a chamber for receiving a plurality of candies. The chamber has a dispensing opening and an arm for urging candies in the chamber so that one candy is always located adjacent the dispensing opening. A second arm and a push rod are provided for dispensing candies through the dispensing opening. In one embodiment such a candy dispensing apparatus may be combined as part of a children's wrist watch.

U.S. Pat. No. 5,665,304 issued to Heinen et al. on Sep. 9, 1997 entitled Display Unit teaches a rack unit display system is provided to display goods, such as in a retail store, in a well structured and ordered manner. The goods are horizontally stacked in the rack unit. A theft protection member is provided which limits unauthorized access to the goods. The left protection member is adjustable in height to allow the display unit to accommodate different sized goods. The goods are pushed forward in the unit by a slide member where the units can then be removed from the rack in small quantities. The back unit is releasably mounted and secured by a lock mechanism on a base member, which in turn is mounted on a rectangular bar. The rack unit can be released from the base member by means of a key. The slide member can be locked in a rear end position of the display unit when the rack unit is removed from the base member. The unit can be filled or refilled with ease without interference from the slide member. The height of the theft protection member is also adjustable. When the rack unit is mounted on the base member, the slide member is automatically released, thereby pushing goods forward.

U.S. Pat. No. 6,230,931 issued to Mandle et al. on May 15, 2001 entitled Dispensing Package teaches a dispensing package for substantially flat items, such as razor blades, gum and mints. The dispensing package contains a hollow container having a slot on one side and a dispensing door on one end adjacent to the slot. An elevator is located within the track for supporting and lifting the confectionery items. An elevator button is located on one end of the elevator and protrudes through the slot to allow the user to manually raise the elevator and the items located thereon. On the inside of the package and adjacent to the slot is a ratcheting track which corresponds with ratcheting protrusions on the elevator button. The ratcheting track and ratcheting protrusions allow the elevator to move upward in a manner such that only one item at a time is dispensed. Upon the exertion of manual force to lift the elevator button in an upward direction, the elevator is raised via the ratcheting track and protrusions and the top item contacts and pushes open the dispensing door. The product to be used is then removed through the dispensing door.

U.S. Pat. No. 6,536,609 issued to Lake on Mar. 25, 2003 entitled Vial Dispenser teaches a device suitable for dispensing a plurality of like articles therefrom, the device characterized as having a plurality of columns for storing and dispensing the articles, each column having a front opening for dispensing the articles and a bottom side for holding the articles, each column having resilient spring means for biasing the articles towards the front opening of the column, the improvement being a tilt ramp attached to the front opening, wherein the ramp is at a decreased angle.

U.S. Pat. No. 6,749,071 issued to Caterinacci on Jun. 15, 2004 entitled Merchandizing Display. Its abstract teaches a merchandise display device for dispensing and displaying digital media cases. Digital media cases are inserted vertically into the opening between the front panel and the lateral supports. This opening limits the number of cases which can be removed and/or inserted at one time. The width of the opening allows only two cases to be inserted or removed at a time, to deter theft. The opening, however, still allows for easy access when removing or inserting the cases. A replaceable pusher is attached to the back wall of the unit to bias the digital media cases toward the front panel. The display units are broken into two separate components, a right and left side. The components allow for flexibility in arranging the display system, depending on the need of the vendor. The invention provides a storage display system which continuously maintains the organized orientation of digital media cases, displays the covers of these cases, permits easy access and use of the stored objects and allows for flexibility so that the storage units are easy to install, reconfigure, and remove.

U.S. Pat. No. 6,955,268 issued to Waldron on Oct. 18, 2005 entitled Merchandise Display. Its abstract teaches a modular display system for polyhedron shaped merchandise, such as DVD's, software, computer games, CD's and the like, and a method for manufacturing such a display. In a preferred embodiment, the system comprises a plurality of individual pocket constraints configured as integral modules aligned and retained in a set of cascading shelves. The individual pocket modules are an integral form having side constraints, a connecting portion extending between the side portions, and a pushing portion having a merchandise engagement portion connecting to a bias-providing portion. The cascading shelves are, in a preferred embodiment, formed from a plurality of stackable shelves. Each shelf, in a preferred embodiment, has a horizontal lower base, a vertical back side, a vertical front portion, and a horizontal top piece forming generally a G-shape in the cross-section. The shelves are cascaded such that each successive higher shelf is set rearwardly from the shelf below.

United States Patent Publication No. 2007/0045336 filed by Munoz et al. and published on Mar. 1, 2007 entitled Point of Purchase Stand for Displaying and Dispensing a Plurality of Retail Articles teaches a device for the displaying and dispensing of a plurality of retail articles from a point of purchase stand. The device includes a housing having a plurality of faces. A plurality of elongate vertically oriented dispensing magazines are aligned with the faces of the housing. Each magazine supports a plurality of articles in at least one vertically stacked array. Each magazine further includes a dispensing opening at the lower end thereof and an article retaining element for removably supporting one of the articles at the dispensing opening. A display window covers the faces of the housing. The display window retaining the array of articles in the magazine and being transparent for permitting viewing of the articles.

United States Patent Publication No. 2008/0135507 filed by Hardy et al. and published on Jun. 12, 2008 entitled Product Securement and Management System teaches a system for managing and securing product and deterring theft in a retail setting includes a system that resides either on a standard retailer shelf or may be a stand-alone system. In an embodiment, the system includes a plurality of shelves and product dividers positioned between the shelves and extending from the front edges of the shelves toward the rear of the shelves. Front retaining walls are positioned at the front edges of the shelves and are configured to have a height that inhibits access to products on the shelves. Individual retaining tabs of varying height may be added in front of rows of taller product to inhibit access to these products. In an embodiment, rigid or moveable barriers may be positioned above retaining walls that further restrict access to the products. With the invention, the "sweeping" of numerous products by a thief is deterred. In another embodiment, an alert device may be configured to detect and monitor movement of the moveable barriers and may provide an alert signal corresponding to the management of product on the shelf or corresponding to a potential theft situation. In an embodiment, the alert device may communicate with a security camera to monitor the vicinity and provide a notification to the potential thief that his actions are being monitored and recorded, or provide a notification to store computer, pager, cellular telephone, or the like. In yet another embodiment, lock mechanisms may be used to further secure high-risk theft items. Also, clips or clip members may be incorporated to further secure the product dividers to the shelves. In addition, an adjustable power bar may be included that is adjustable to accommodate the height adjustments made to the shelves.

These prior art patents are very limited in their teaching and utilization, and an improved display assembly is needed to overcome these limitations.

SUMMARY OF THE INVENTION

The present invention is directed to improved dispensing display assembly which can deter the theft of goods without prohibitively restricting the access to goods. In accordance with one exemplary embodiment of the present invention, a display assembly is provided using an interior frame with a wrapped exterior having an advertising element. The frame and wrapped exterior are made from corrugated paper or a thin walled plastic. Advantages of the present invention include: a theft-detering display assembly, easy change out of display graphics for different products; inexpensive or replaceable materials for low cost impact on actual product marketing costs; and a structurally sound display for use in retail and other environments.

It is an object of the present invention to provide an aesthetic display system.

A further object of the present invention is to provide an inexpensive display assembly.

A still further object of the present invention is directed to provide a display assembly that provides for a display that deters theft of products.

Yet another object of the present invention is to provide a display assembly that is structurally sound without requiring adhesives or additional fasteners or connectors.

A still further object of the present invention is to provide a lightweight compact display assembly.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 15:
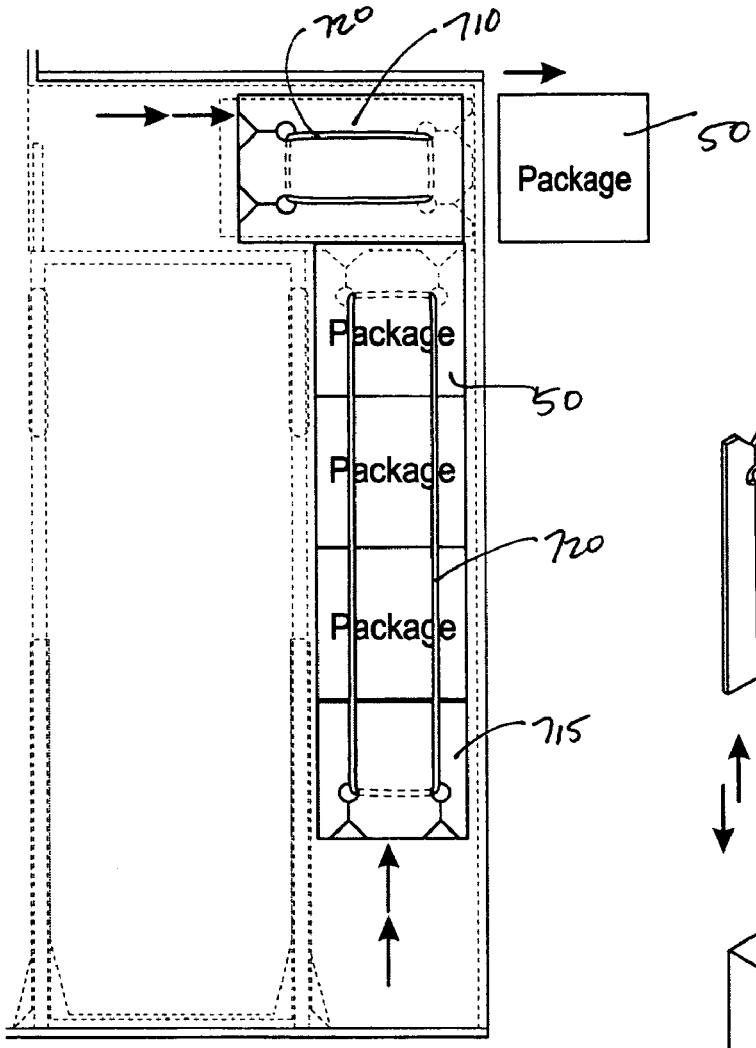
FIG. 15 is a cross-sectional view along line 8-8 showing the dispensing motion.
Figure 16:
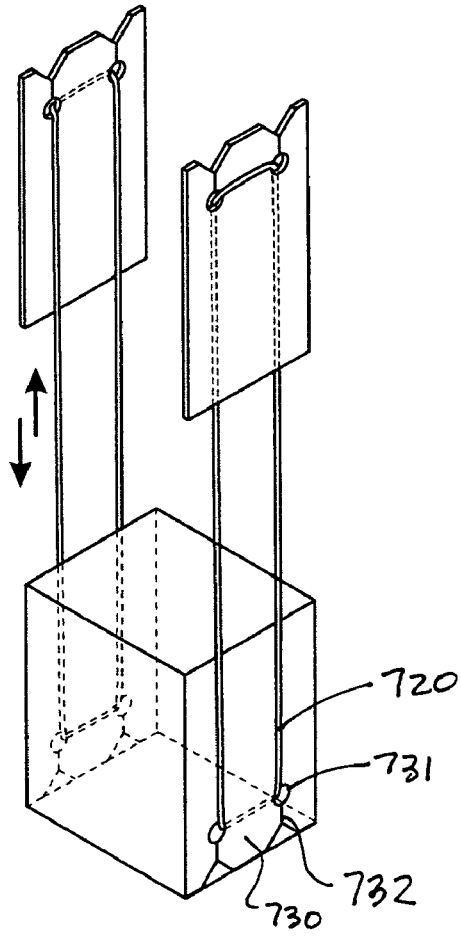
FIG. 16 is a partial view of a plunger with portions of the side walls removed.
Figure 17:
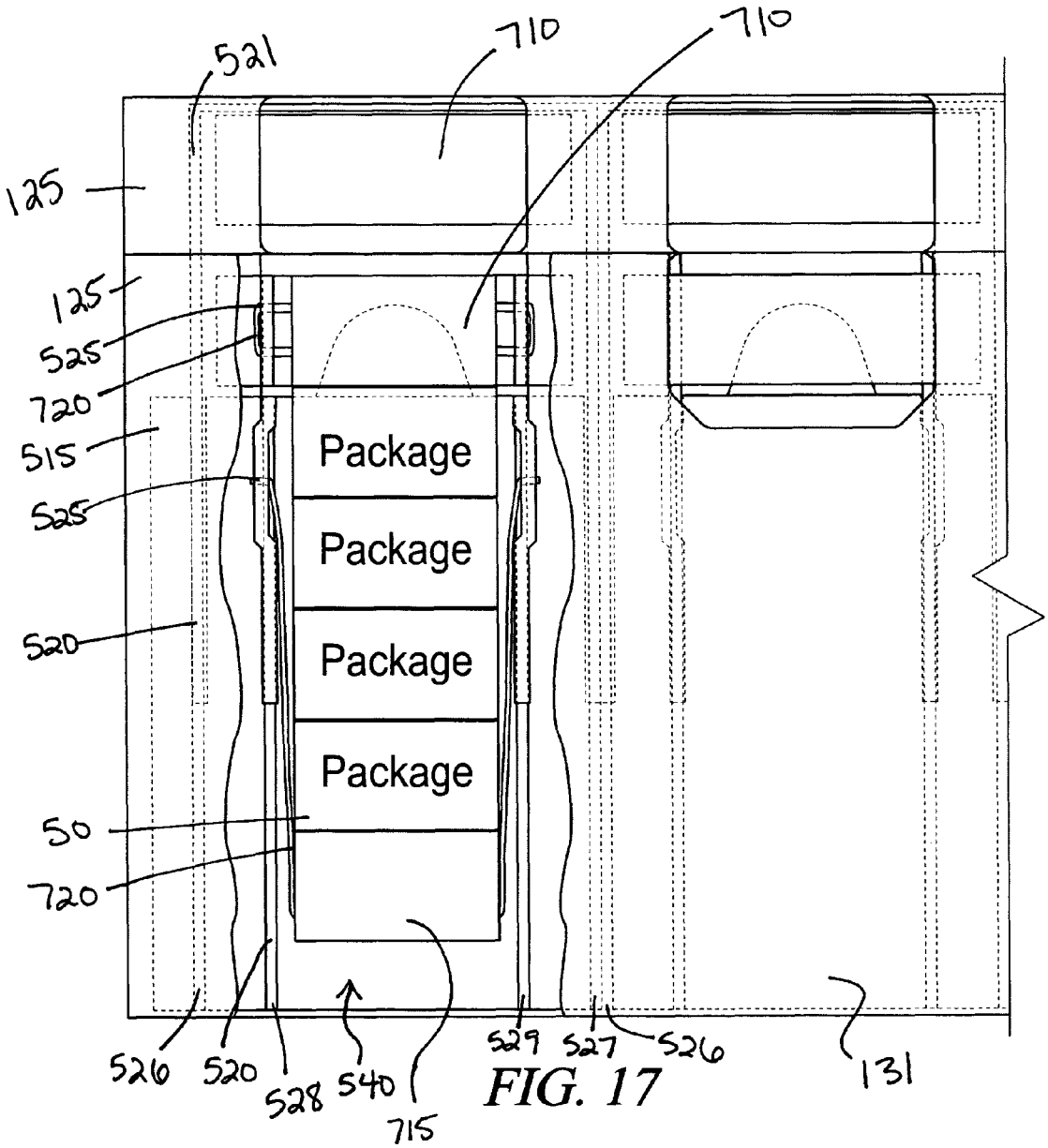
FIG. 17 is a partial view of the front side with a portion of the front side removed.

FIGS. 1-7 show the display assembly 100 as presented to a customer. FIGS. 8-15 show a cross-sectional view of the display assembly and show the internal mechanism and movement of the dispensing function. FIGS. 16 and 17 show portions of the internal mechanism in detail.

The display assembly 100 is constructed to display a variety of items, including beverage containers, tablet containers, or similar containers as described herein. As shown in FIGS. 1-7, the display 100 consists of an exterior shell 300, which may be composed of a paperboard material, corrugated material, or thin walled plastic, surrounding an interior frame 500, which may be composed of a paperboard material, corrugated material, or thin walled plastic, holding product, and a dispensing mechanism 700, which may be composed of a paperboard, corrugated material or a thin walled plastic, attached to the interior frame 500.

As shown in FIGS. 1-8, the display 100 features multiple dispensing apertures 110. Each dispensing aperture 110 is fed by a product magazine 510. The amount of product 50 contained within the dispensing magazine 540 is limited by the size of the product 50 and the overall size of the magazine 510. Therefore, to limit the time spent refilling the display 100, the display 100 features multiple bays 125 of apertures 110.

The exterior shell 300 is a unitary piece which fits around the interior frame 500. The exterior shell 300 is generally rectangular with a front 131, a back 132, a left side 133, a right side 134, a top 135, and a bottom 136. The shape of the exterior shell 300 is dictated by the arrangement of the dispensing magazines of the interior frame 500. The addition of an additional bay 125, as shown in the drawings, creates a second front 137 along the additional bay above the top 135 of the first bay 125 and a second top 138. The bottom 136 includes attachment flaps (not shown) which fold into the back 132 of the exterior shell creating a continuous exterior shell. To access the interior frame, a user detaches the bottom 136 from the back 132, swings the bottom parallel to the front 131, and lifts the exterior shell 300 off the frame 500.

The dispensing apertures 110 allow product to exit the dispensing display 100 after a consumer activates the dispensing mechanism. Each aperture is large enough to allow the product 50 to exit the display 100 unimpeded. As shown, the apertures 110 feature a semi-circular edge 111 on the top 135 side of the display along the corner edge of the front side 131 of the display. The larger opening created by the semi-circular edge allows for a user to press the top plunger 710 of the internal dispensing mechanism 700 during the dispensing function even while the product 50 is at the upper limit of the magazine 510. The semi-circular edge 111 connects with the rest of the aperture on the front side 131 which is generally rectangular with an arcuate bottom edge 112 parallel to the top edge of the front side 131. The arcuate bottom edge 112 allows a consumer to glimpse the product within the magazine 510 to verify the display is stocked before pressing the top plunger 710 to activate the dispensing mechanism.

Figure 1:
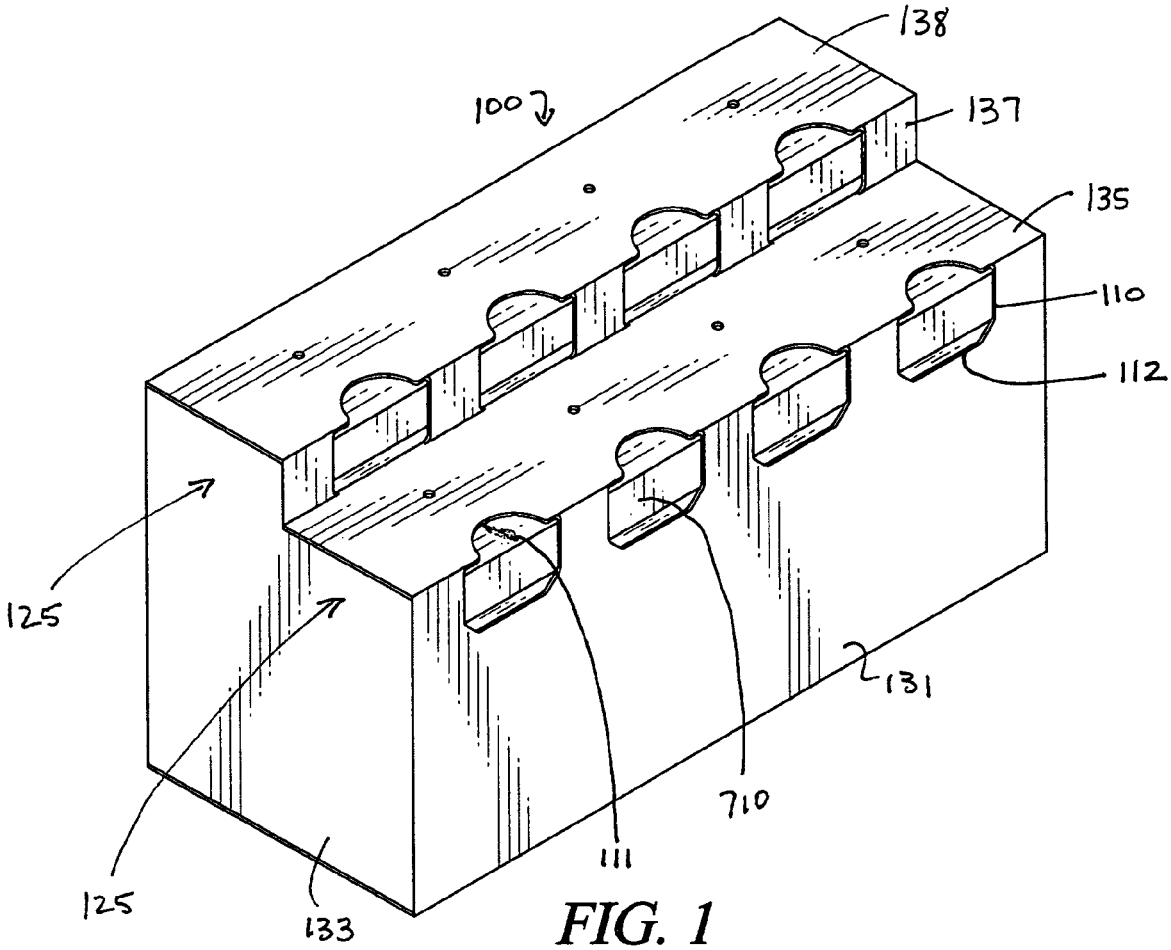
FIG. 1 is a perspective view of a first exemplary embodiment of the present invention.
Figure 2:
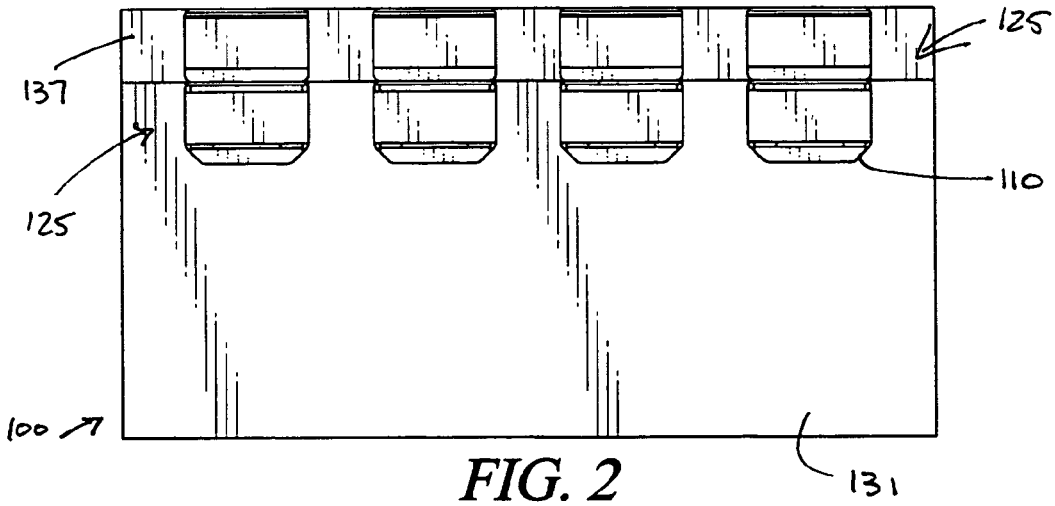
FIG. 2 is a front side elevational view of thereof.
Figure 3:
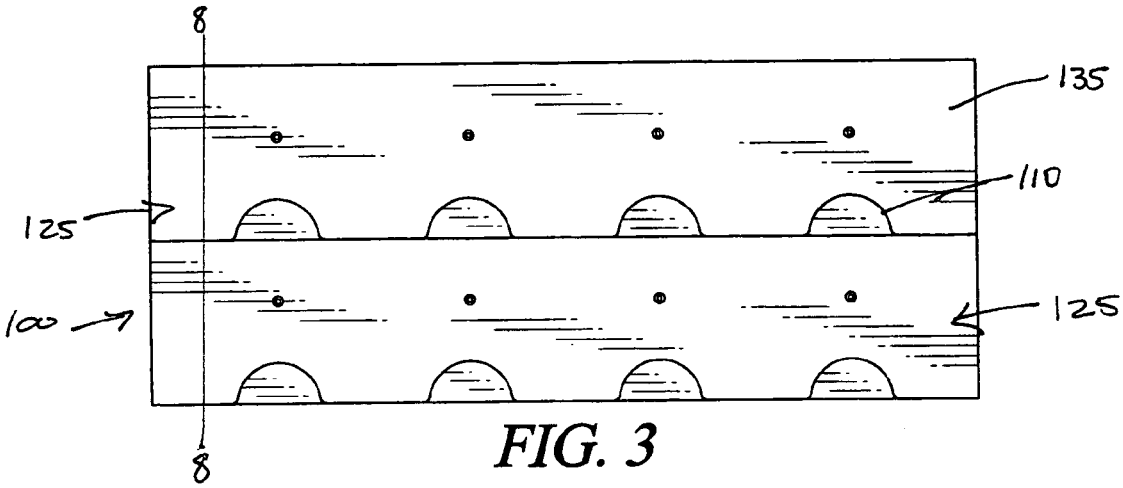
FIG. 3 is a top plan view thereof showing line 8-8
Figure 4:
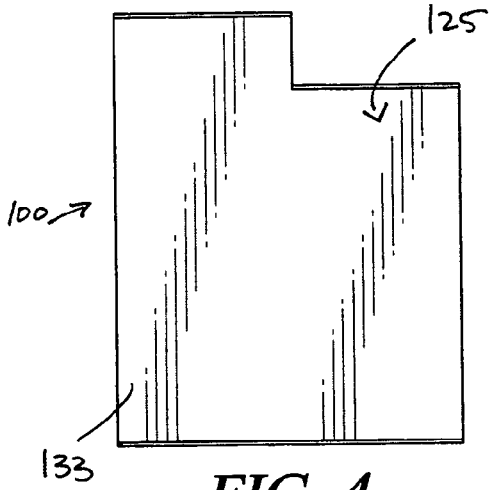
FIG. 4 is a left side elevational view thereof.
Figure 5:
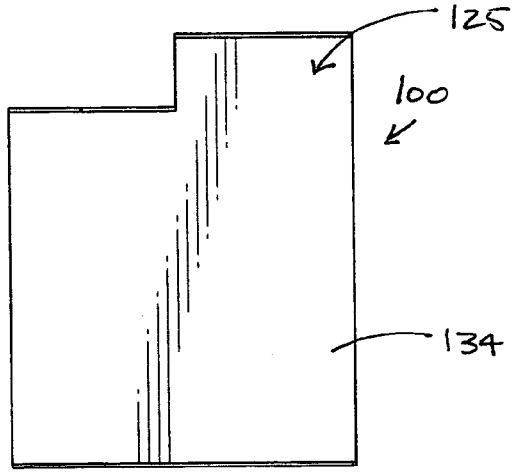
FIG. 5 is a right side elevational view thereof.
Figure 6:
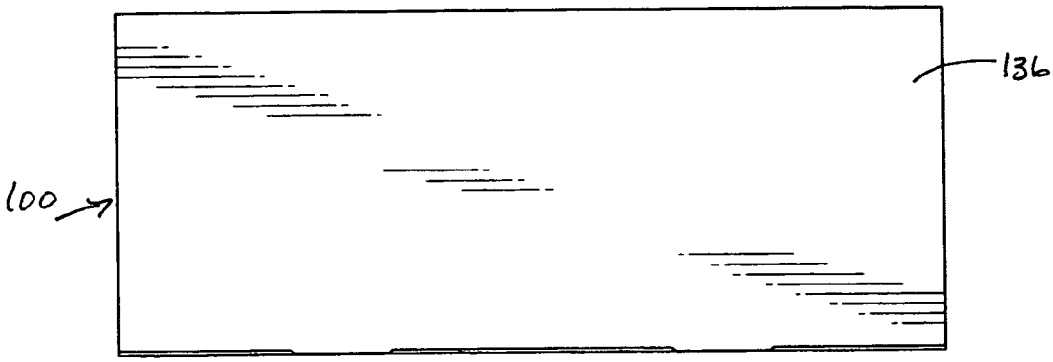
FIG. 6 is a bottom plan view thereof.
Figure 7:
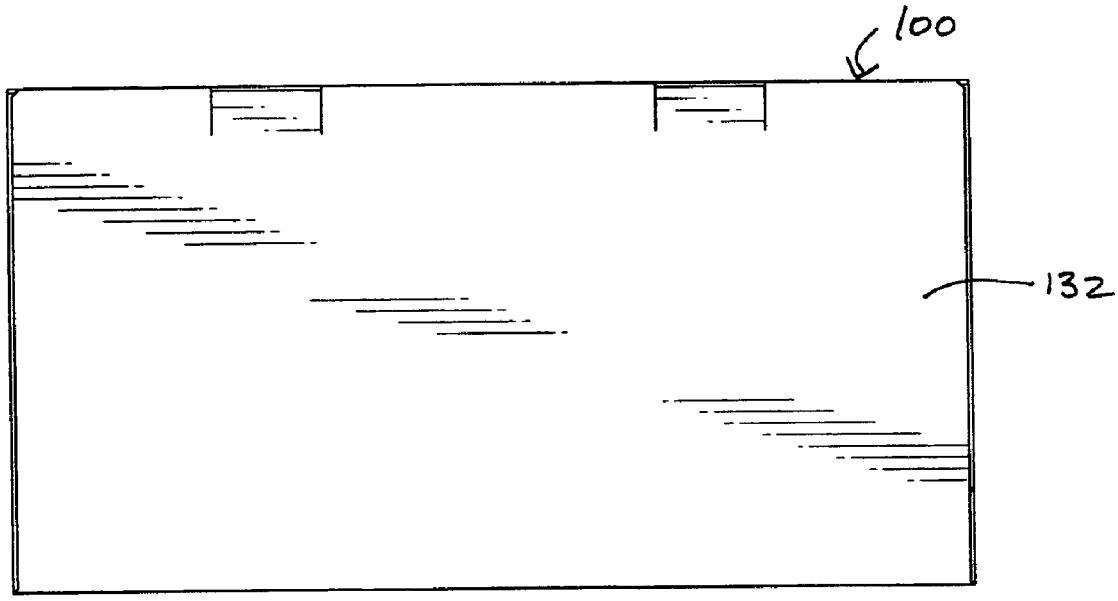
FIG. 7 is a back side elevational view thereof.
Figure 8:
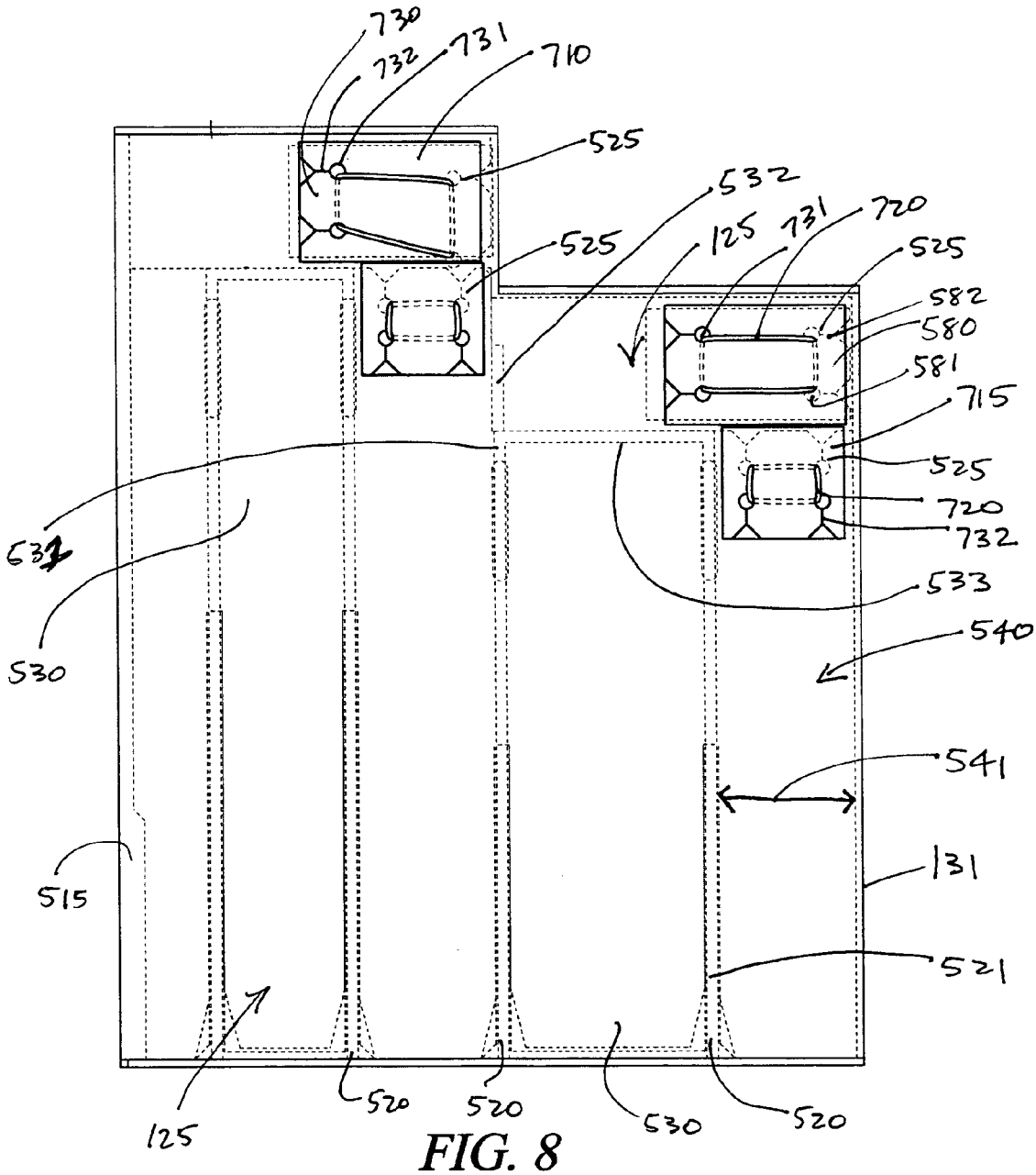
FIG. 8 is a cross-sectional view along line 8-8.

As seen in FIG. 8, the interior frame 500 generally includes reinforcing material 515 to stabilize the interior frame within the exterior shell 300, a multitude of side walls 520 providing anchors 525 for the dispensing mechanism 700, and reinforcing columns 530 supporting the movement of the dispensing mechanism 700. As many of the parts of the interior frame are oriented perpendicular to the front side 131 of the display, this disclosure will utilize the front side 131 as a reference point.

The reinforcing material 515 is provided as a stabilizing material on all sides of interior frame 500 to prevent movement of the frame within the exterior shell 300. The reinforcing material is generally connected to the frame 500 perpendicular to each outermost right side and left side wall 521 of the frame 500 with the outer edge connecting the exterior frame 300.

The side walls 520 anchor the dispensing mechanism 700 and provide a repository of the products 50. The product is secured on all sides of the product to insure the product 50 does not twist, turn or slide out of alignment during dispensing. As shown in FIG. 8, the side wall 520 restraints parallel to the front side 131 are visible. The perpendicular restraints will be discussed are detailed in FIG. 17 and will discussed at length below.

The side walls 520 form the dispensing magazine 540. As shown, the front side 131 of the exterior shell 300 forms the front of the dispensing magazine 540. The rear side wall 521 is parallel to the front side 131. The distance 541 between the rear side wall 521 and the front side 131 is only a small amount larger the width 54 as the product 50.

The reinforcing columns 530 are positioned along the back of the bay 125 behind the dispensing mechanism 700. The top plunger 710 rests atop the reinforcing columns 530 during the backward movement of the plunger 710. The reinforcing columns provide stability during this movement, restricting any forward movement or tipping of the display. To further restrict movement, the reinforcing columns 530 may be weighted. The rear wall 531 of the reinforcing columns extends higher than the top 533 to provide a backstop 532 for the top plunger 710.

The dispensing magazine 540 is further formed by the side walls 520 perpendicular to the front side 131. FIG. 17 provides a cutaway of the front side 131 showing one dispensing magazine 540. The perpendicular side walls of the dispensing magazine 540 are a left wall 526, a right wall 527. The top plunger 710 is attached to the upper portion of the left wall 526 and right wall 527 while the bottom plunger is attached to the lower portion of the left wall 526 and 527. Each upper portion and lower portion of the perpendicular side wall 520 has an attachment anchor 580 (shown in dashed lines in FIG. 8) having a pair of slits 582 running from the edge of the side wall on corresponding the right and left side of the plunger. Each slit terminates into an aperture 581 adapted to hold the band 720. A band 720 is threaded through the slits 852 on each side of the plunger. In this manner, the bands 720 are connected to the frame 500.

The dispensing mechanism 700 is composed of two plungers 710, 715 and multiple bands 720, such as a rubber or elastic bands. Each plunger 710, 715 is a rectangular block having five sides. The rear side (not shown in the drawings) is open, allowing for the attachment of the bands 720 on the left and right sides of the plungers 710, 715. Each plunger 710, 715 has an attachment anchor 730 having a pair of slits 732 running from the rear edge of the plunger 710, 715 on the right and left side of the plunger. Each slit terminates into an aperture 731 adapted to hold the band 720. A band 720 is threaded through the slits 732 on each side of the plunger. Preferably, one band 720 is used for each side. The bands are then connected to a similar structure on the frame 500. In this manner, the plungers are attached to the frame.

FIG. 8 shows both the top plunger 710 and the bottom plunger 715 in their relaxed state without products 50 present. When the bands 720 are relaxed, the top plunger 710 rests near the front side 131 of the exterior shell 300 near the aperture 110 and the bottom plunger 715 rests immediately below the top plunger 710.

Figure 9:
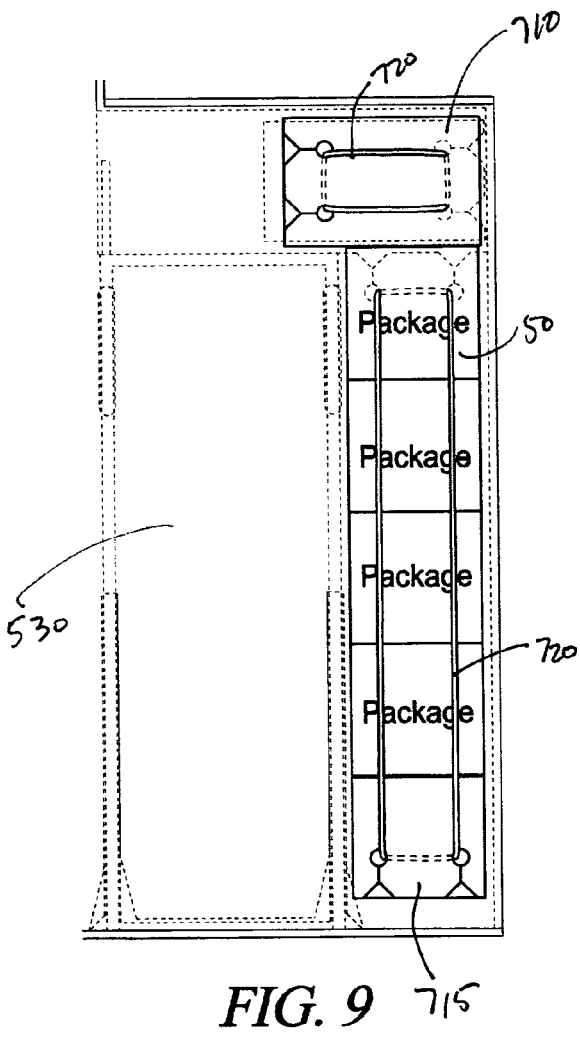
FIG. 9 is a cross-sectional view along line 8-8 showing the dispensing motion.

FIG. 9 shows the top plunger 710 in its relaxed state and the bottom plunger 715 with products 50 present. As when the both plungers are relaxed, the top plunger 710 rests near the front side 131 of the exterior shell 300 near the aperture 110. The bottom plunger 715 is biased downwards below product 50. As shown, the magazine is full of product, so the bottom plunger 715 is biased to the bottom of the dispensing magazine 540, thus stretching the bands 720.

Figure 10:
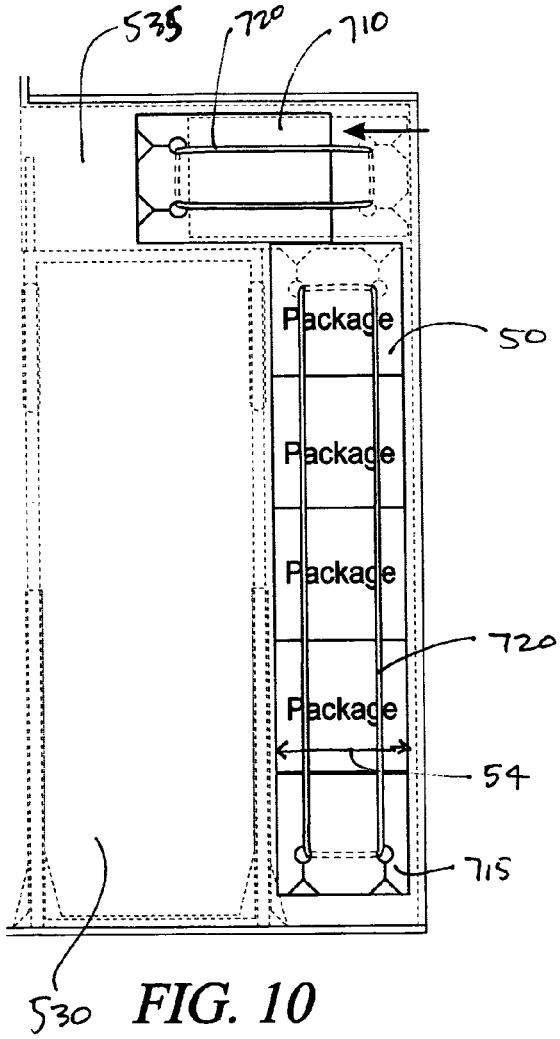
FIG. 10 is a cross-sectional view along line 8-8 showing the dispensing motion.
Figure 11:
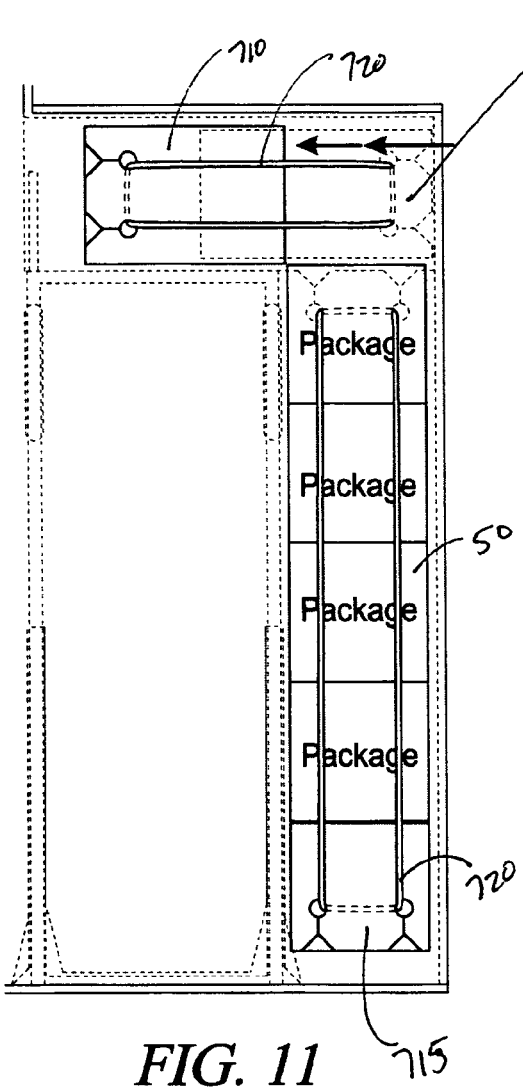
FIG. 11 is a cross-sectional view along line 8-8 showing the dispensing motion.

When the top plunger 710 is pushed inward by a user through the dispensing aperture 110, the top plunger 710 is pushed along a channel 535 atop the reinforcing column 530 and the top plunger bands 720 are stretched. As shown in FIG. 10, until the top plunger 710 moves back beyond the width 54 of the products 50 (as shown in FIG. 11), the bottom plunger 710 and stack of product 50 remains depressed in the dispensing magazine 540.

Figure 12:
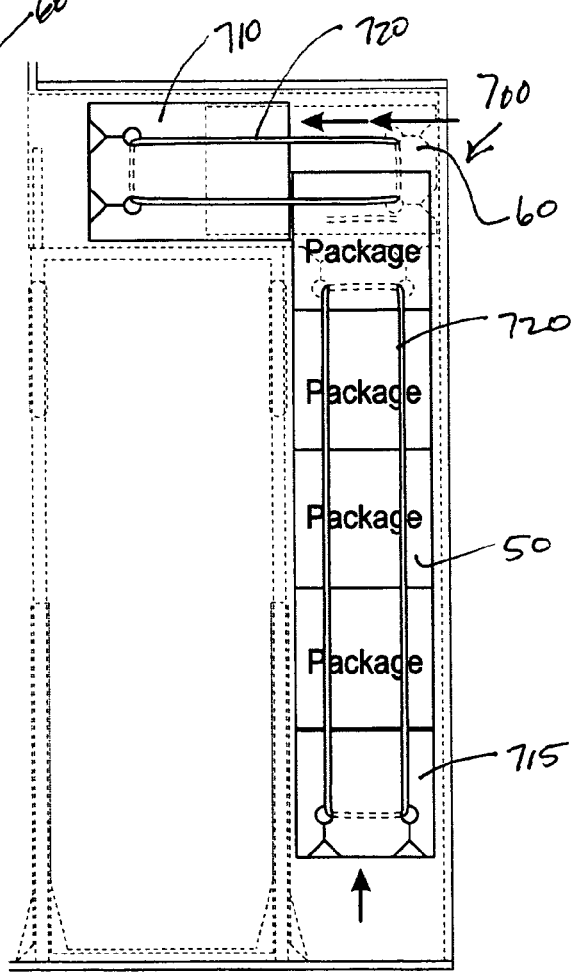
FIG. 12 is a cross-sectional view along line 8-8 showing the dispensing motion.
Figure 13:
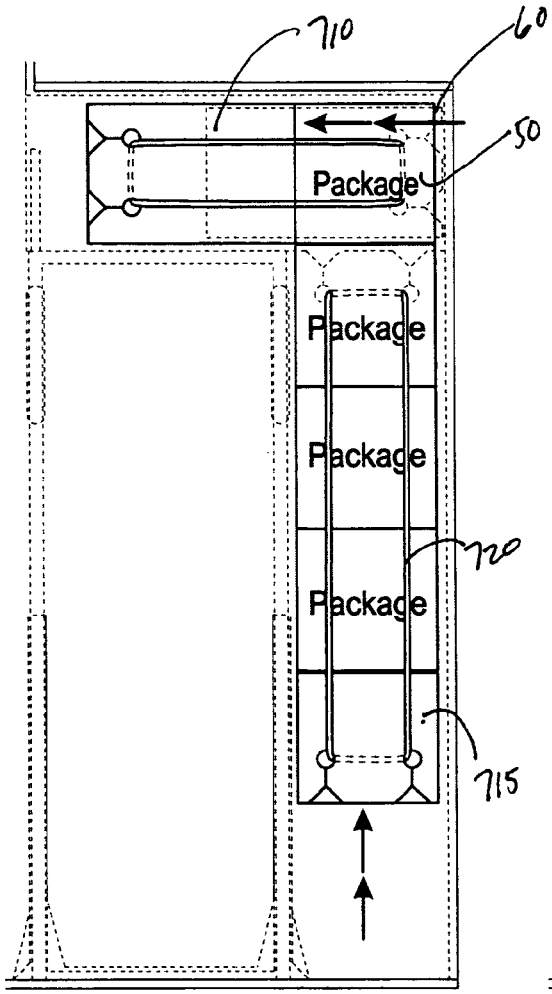
FIG. 13 is a cross-sectional view along line 8-8 showing the dispensing motion.

As shown in FIG. 12, the rearward movement of the top plunger 710 beyond the product width 54 releases the downward pressure on the column of products on the bottom plunger 715, thus allowing a product to move into the space 60 vacated by the top plunger 710. The bands 720 attached to the bottom plunger relax until the product reaches the top of the empty space 60 immediately in front of the aperture 110 (as shown in FIG. 13).

Figure 14:
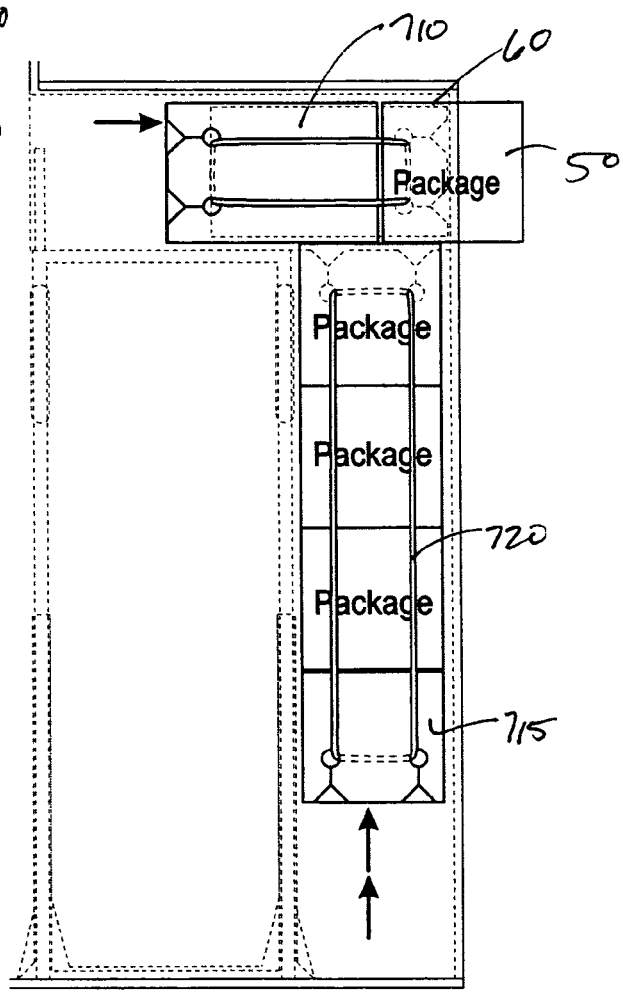
FIG. 14 is a cross-sectional view along line 8-8 showing the dispensing motion.

As shown in FIG. 14, once the product package 50 occupies the space proximate 60 the aperture 110, the customer is no longer able to bias the top plunger 710 rearward any longer. The tension on the top plunger bands 720 is thus released, allowing the top plunger 710 to move forward, pushing the product 50 out through the aperture 110. As shown in FIG. 15, the top plunger 710 comes to rest again atop the next package 50 or the top of the bottom plunger 715.

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

What is claimed is:

1. A product dispenser for providing at least one product item, the product dispenser comprising:

an exterior shell having a dispensing aperture to allow the product item to exit the product dispenser, an interior frame supporting said exterior shell, said interior frame comprising:

a product magazine configured to hold the product item in a column, said product magazine having two perpendicular side walls perpendicular to the longitudinal axis of said product dispenser and two parallel side walls parallel to the longitudinal axis of said product dispenser;

a reinforcing column positioned anterior to said product magazine;

a dispensing mechanism supported by said interior frame, said dispensing mechanism comprising:

a top plunger flexibly connected to said two perpendicular side walls;

a bottom plunger flexibly connected to said two perpendicular side walls and biased downward beneath said product item column, said bottom plunger configured to move from a lower dispensing position within said product magazine to a higher dispensing position within said product magazine upon movement of said top plunger;

said top plunger configured to move within said product magazine from a relaxed position with said top plunger proximate to said dispensing aperture of said exterior shell to a first dispensing position with said top plunger biased anterior to said dispensing aperture and resting upon said reinforcing column to a second dispensing position with said top plunger anterior the product item biased upward by said bottom plunger, said top plunger returning to said relaxed position thereby pushing the product item through said dispensing aperture.

2. The exterior shell of claim 1, said dispensing aperture having an arcuate bottom edge configured to allow a consumer to glimpse the product item within said product magazine.

3. The dispensing mechanism of claim 1, said dispensing mechanism further comprising at least one flexible band flexibly connecting said top plunger and said bottom plunger to said two perpendicular side walls.

4. The interior frame of claim 1, further comprising an upper channel above said reinforcing column and anterior to said top plunger when said top plunger is in said relaxed position.

5. The product magazine of claim 1, said two perpendicular side walls and said two parallel side walls proximate to the product item in a column thereby maintaining the product item from twisting out of the column.

6. A product dispenser for providing at least one product item, the product dispenser comprising:

an exterior shell having a dispensing aperture to allow the product item to exit the product dispenser, an interior frame supporting said exterior shell, said interior frame comprising:

a multitude of product magazines configured to hold the product item in a column, said product magazines each having two perpendicular side walls perpendicular to the longitudinal axis of said product dispenser and two parallel side walls parallel to the longitudinal axis of said product dispenser;

a reinforcing column positioned anterior to each of said product magazines;

a dispensing mechanism supported by said interior frame, said dispensing mechanism comprising:

a top plunger having an attachment anchor flexibly secured to said two perpendicular side walls;

a bottom plunger having an attachment anchor flexibly secured to said two perpendicular side walls and biased downward beneath said product item column, said bottom plunger configured to move from a lower dispensing position within said product magazine to a higher dispensing position within said product magazine upon movement of said top plunger;

said top plunger configured to move within said product magazine from a relaxed position with said top plunger proximate to said dispensing aperture of said exterior shell to a first dispensing position with said top plunger biased anterior to said dispensing aperture and resting upon said reinforcing column to a second dispensing position with said top plunger anterior the product item biased upward by said bottom plunger, said top plunger returning to said relaxed position thereby pushing the product item through said dispensing aperture.

7. The exterior shell of claim 6, said dispensing aperture having an arcuate bottom edge configured to allow a consumer to glimpse the product item within said product magazine.

8. The dispensing mechanism of claim 6, said dispensing mechanism further comprising at least one flexible band flexibly securing said top plunger and said bottom plunger to said two perpendicular side walls.

9. The interior frame of claim 6, further comprising an upper channel above said reinforcing column and anterior to said top plunger when said top plunger is in said relaxed position.

10. The product magazine of claim 6, said two perpendicular side walls and said two parallel side walls proximate to the product item in a column thereby maintaining the product item from twisting out of the column.

11. A product dispenser for providing at least one product item, the product dispenser comprising:

a frame comprising a product magazine configured to hold the product item in a column, said product magazine having two perpendicular side walls perpendicular to the longitudinal axis of said product dispenser and two parallel side walls parallel to the longitudinal axis of said product dispenser;

a dispensing mechanism supported by said frame, said dispensing mechanism comprising:

a top plunger having an attachment anchor flexibly secured to said two perpendicular side walls;

a bottom plunger having an attachment anchor flexibly secured to said two perpendicular side walls and biased downward beneath said product item column, said bottom plunger configured to move from a lower dispensing position within said product magazine to a higher dispensing position within said product magazine upon movement of said top plunger;

said top plunger configured to move within said product magazine from a relaxed position with said top plunger proximate to the front of said product magazine to a first dispensing position with said top plunger biased backwards to a second dispensing position with said top plunger anterior the product item biased upward by said bottom plunger, said top plunger returning to said relaxed position thereby pushing the product item away from said top plunger to exit said product magazine.

12. The frame of claim 11, further comprising a reinforcing column positioned anterior to said product magazine.

13. The interior frame of claim 12, further comprising an upper channel above said reinforcing column and anterior to said top plunger when said top plunger is in said relaxed position.

14. The product dispenser of claim 11, further comprising an exterior shell having a dispensing aperture to allow the product item to exit the product dispenser.

15. The exterior shell of claim 14, said dispensing aperture having an arcuate bottom edge configured to allow a consumer to glimpse the product item within said product magazine.

16. The dispensing mechanism of claim 11, said dispensing mechanism further comprising at least one flexible band flexibly securing said top plunger and said bottom plunger to said two perpendicular side walls.

17. The product magazine of claim 11, said two perpendicular side walls and said two parallel side walls proximate to the product item in a column thereby maintaining the product item from twisting out of the column.

* * * * *